United States Patent [19]

Chang

[11] 3,955,766

[45] May 11, 1976

[54] PULVERIZING MILLS

[76] Inventor: Shien-Fang Chang, No. 55 Chung-Cheng Road, Hsin-Ying Chen, Tainan Hsien, China /Taiwan

[22] Filed: Oct. 12, 1971

[21] Appl. No.: 188,377

[52] U.S. Cl. ..... 241/56; 241/114; 241/129

[51] Int. Cl.[2] ..... B02C 23/28

[58] Field of Search ..... 241/48, 53, 56, 58, 241/109, 110, 114, 129, 133

[56] References Cited

UNITED STATES PATENTS

| | | | |
|---|---|---|---|
| 252,755 | 1/1882 | Gates | 241/109 |
| 2,092,307 | 9/1937 | Gaffney | 241/53 |
| 3,221,998 | 12/1965 | Lykken | 241/56 |
| 3,268,179 | 8/1966 | Glynn et al. | 241/53 X |
| 3,339,853 | 9/1967 | Mischanski | 241/114 X |

*Primary Examiner*—Granville Y. Custer, Jr.

[57] ABSTRACT

Pulverizing apparatus comprising a vertical feed mechanism, a vertical mill cylinder in which raw material is fed, ground at one level, classified at another level and exhausted through a top portion to a collector and filter with particles of undesired sizes being returned to the mill for regrinding.

3 Claims, 10 Drawing Figures

PULVERIZING MILLS

BACKGROUND OF INVENTION

This invention relates to improvements in pulverizing mills.

Known large scale pulverizers include hammer mills, ball mills and roller mills. They are characterized by certain disadvantages, such as complex construction, high power requirement, large mounting area and high installation cost. Moreover, because of inadequacy of their anti-shock, sound-deadening and dust-proof devices, substantial noise vibrations and wide spreading of dust, are generated during operation. Also, they have low efficiency of pulverization, with the particles rarely being 300 mesh and are incapable of pulverizing fibrous and viscous materials.

SUMMARY OF INVENTION

An object of the invention is to eliminate the above-discussed disadvantages and provide a vertical, centrifugal ring-roller mill with speed reducer, pulverizer, classifier, and exhaust fan fitted on a vertical shaft driven by a motor mounted on top of the mill and with a bag-type filter fitted around the support frame of a cyclone type dust collector, so as to simplify construction of the transmission system and to minimize the mounting area, and furthermore using threaded grinding rollers to increase grinding efficiency.

DETAILED DESCRIPTION OF PREFERRED EMBODIMENT

Figure 1:
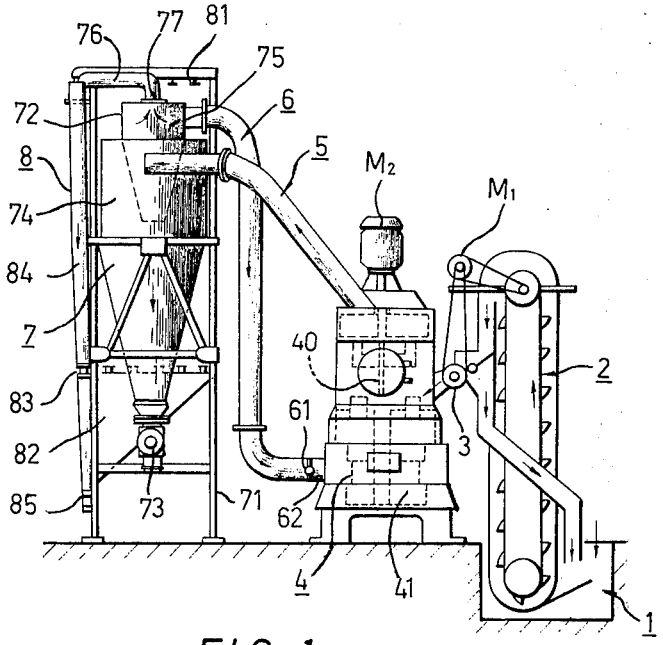
FIG. 1 is a perspective diagrammatic side view of an illustrative embodiment of the invention.
Figure 2:
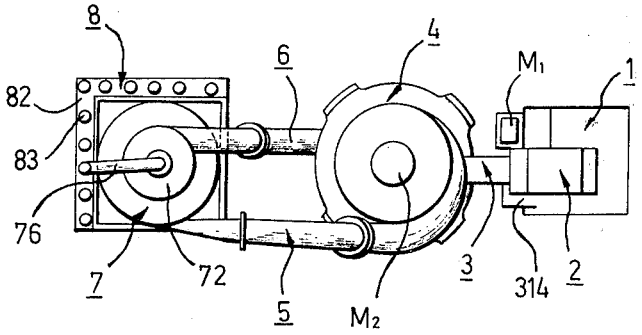
FIG. 2 is a top view of the embodiment of FIG. 1.

Turning now to the figures, especially FIGS. 1 and 2, there is depicted a raw material source or bin 1, elevator 2, feeder 3, pulverizer 4, uptake pipe 5, air return pipe 6, cyclone type dust collector 7 and bag-type filter 8.

Figure 3:
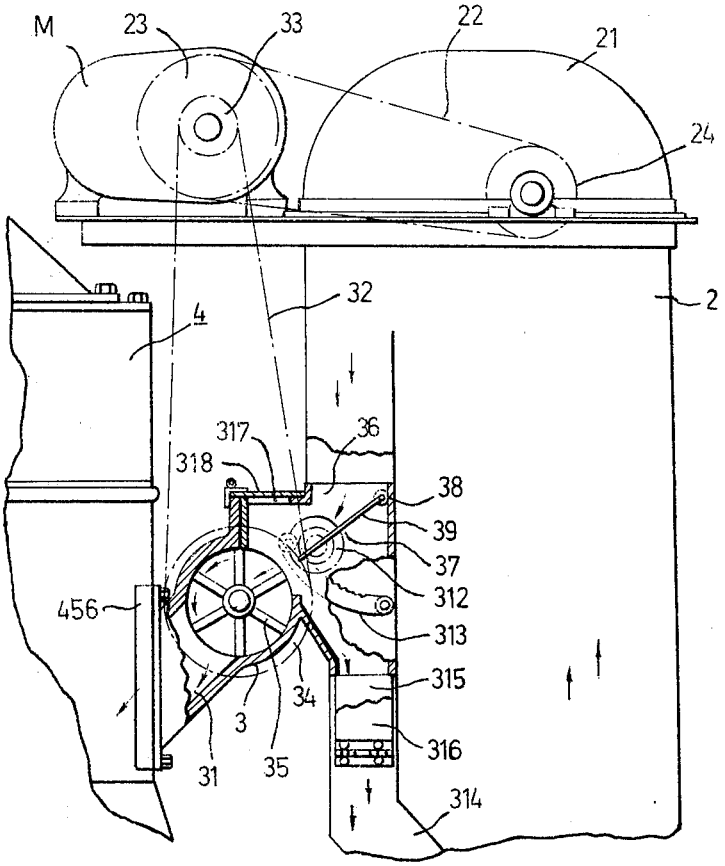
FIG. 3 is a side view of feeder and related elements, shown partly in cross-section.

Raw material bin 1 is provided at the bottom of elevator 2. Raw material for pulverization is conveyed from bin 1 to feeder 3 by elevator 2 which is driven by electric motor $M_1$ mounted on housing 21 of elevator 2 (see FIG. 3) through a sprocket type chain 22 and two sprockets 23,24.

Feeder 3 comprises feeding rotor 35 fitted in supply chamber 31 and driven by electric motor $M_1$ through another sprocket chain 32 and two sprockets 33,34 and a supply adjustment device 37 fitted at feed port 36 to adjust the supply of raw material fed to feeding rotor 35. Supply adjustment device 37 comprises an adjustable deflector plate 39, connecting arm 310, adjusting handle 312 and rack 313. One end of adjustable deflector plate 39 located inside of feed port 36 is secured with a pivot on the inner wall of the housing to swing freely and be able to optionally adjust the extent of opening of feed port 36.

Figure 4:
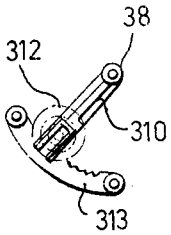
FIG. 4 is a sketch showing the mechanism of the supply adjustment device of the feeder.
Figure 5:
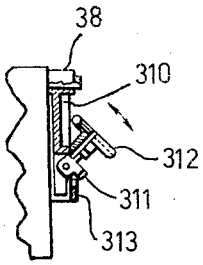
FIG. 5 is a side view of the supply adjustment device shown in cross-section.

As shown in FIGS. 4 and 5, connecting arm 310 is secured to pivot 38 of deflector plate 39, extending to the end outside of the feed port. Adjusting handle 312 is secured with a pivot below connecting arm 310 to swing feely with another end fitted with pawl 311. Rack 313 located at the lower end of connecting arm 310 is secured to the outer wall of the housing and engaged with pawl 311. Lifting adjusting handle 312 upward with pivot 38 as center of action causes disengagement of pawl 311 and rack 313. Thus, if adjusting handle 312 is held and connecting arm 310 is moved with pivot 38 as center of action along an arc to an appropriate position and then handle 312 is lowered, pawl 311 will engage the teeth of rack 313 and will be sent at a corresponding position and angle with deflector plate 39 and connecting arm 310.

Raw material return pipe 314 has one end accessible to feed port 36 and another end accessible to raw material bin 1. When raw material exceeds the required amount acceptable to feeding rotor 35, the over-charge will return to bin 1 via pipe 314. At the upper portion of pipe 314 is provided a glass window 315 for inspection of raw material. On the outside there is a hinged check window 316 free to open and close. Inspection window 317 may be used for checking the condition of the material supply. There is also a hinged check-window 318 free to open and close on the outside.

Figure 6:
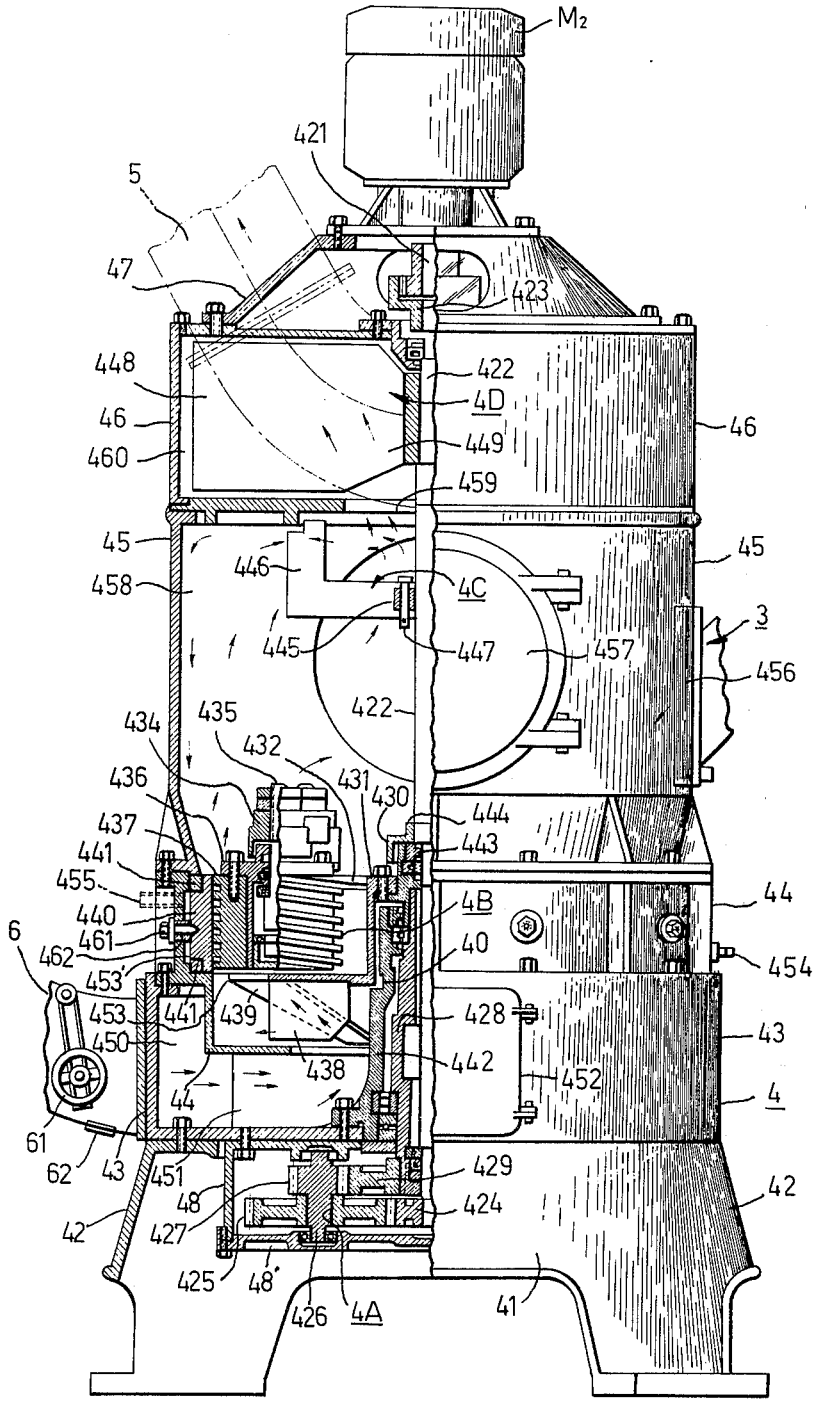
FIG. 6 is a front view of the mill cylinder, half of which is shown in cross-section to display its construction.
Figure 7:
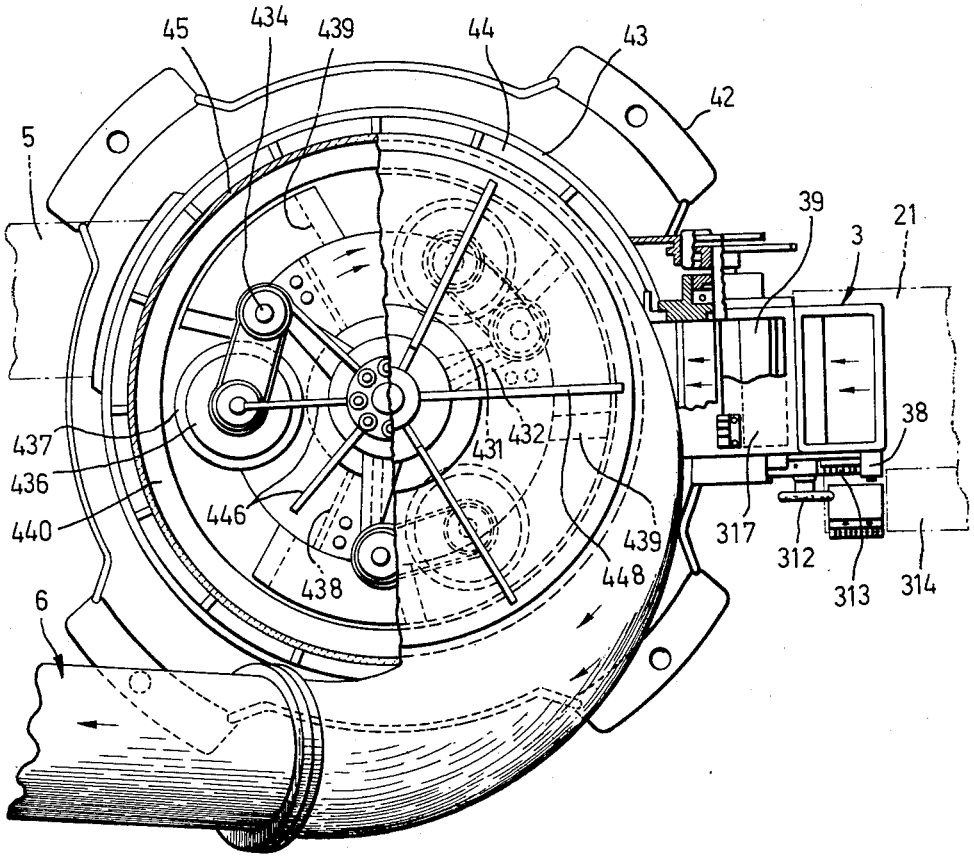
FIG. 7 is a top view of the grinding roller device, shown partly in cross-section.

Ring-roller mill 4 (see FIGS. 6 and 7) is divided into two parts: external mill cylinder 41 and internal mechanism 40. From bottom to top mill cylinder 41 has a mounting seat 42, air housing 43, lower housing 44, middle housing 45, upper housing 46 and seat frame 47 for electric motor $M_2$.

Motor $M_2$ is fixed at the central portion of the top of seat frame 47, enabling motor shaft 421 to vertically extend into mill cylinder 41 under it. Upper end of main shaft 422 is connected to motor shaft 421 with a gear coupling. Its lower end passes through the center of the mill cylinder 41 into the interior of a gear box 48 located in the upper half of mounting frame 42 and fixed to the lower part of air housing 43, and forms a state of suspension with motor shaft 421 maintaining vertical in mill cylinder 41.

On shaft 422 are assembled, in order, speed reducer device 4A, grinding roller device 4B, classifier device 4C and dust collector device 4D, all being driven by shaft 422.

Speed reducer device 4A comprises driving gear 424 fixed at the lower end of shaft 422, speed reducing gear 425 engaged with driving gear 424, gear 427 integral with shaft 426 of speed reducing gear 425, and another gear 429 secured to a rotary collar 428, which is provided concentrically with main shaft 422 and around the lower end thereof. The upper and lower end portions of shaft 426 are freely rotatably supported respectively by upper wall and bottom plate 48′ of gear box 48 by means of bearings.

Figure 8:
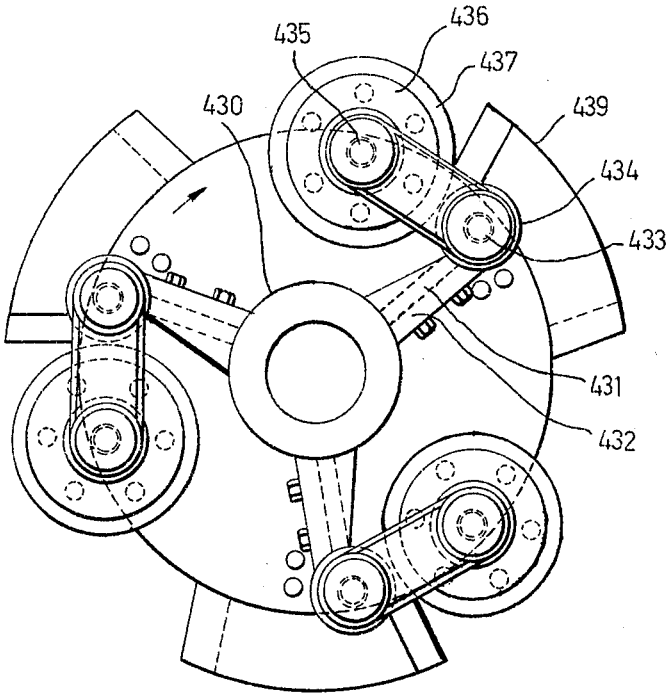
FIG. 8 is a sketch showing the mechanism of the grinding rollers.
Figure 9:
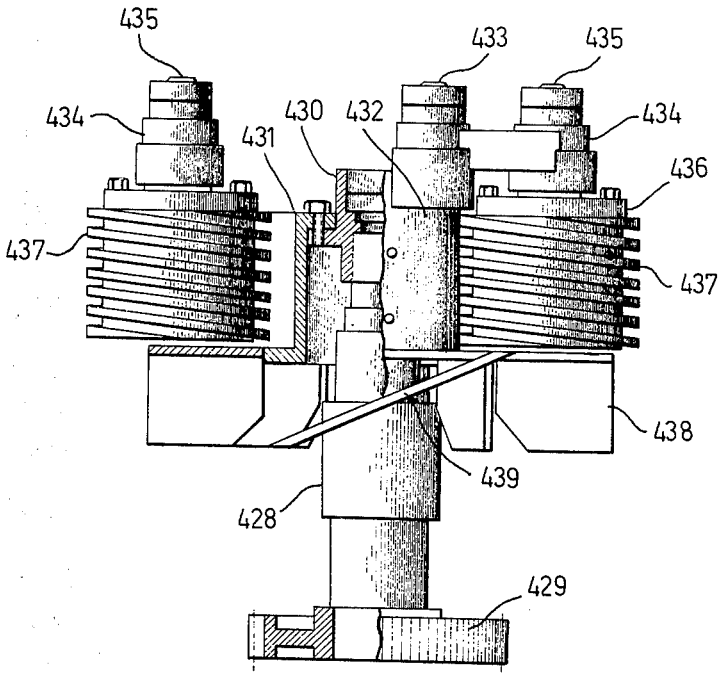
FIG. 9 is a side view of the ring-roller combination shown partly in cut-away section.

Grinding roller device 4B comprises a rotary collar 428 (see FIG. 9) connected with a bearing on main shaft 422 and gear 429, and rotating in the same direction as main shaft 422, a ring 430 keyed to the upper end of collar 428 and rotating with it, (see FIG. 8) a plurality of radial frames 431 (three in this embodiment) connected by means of bolts and nuts to ring 430 by a flange thereon and equally spaced circumferentially thereof. A cantilever support member 432 is fixed to each frame 431 with a cylindrical portion at one end. A roller support arm 434 is connected to the cylindrical portion of each cantilever support member 432 by means of a shaft 433 about which it is freely rotatable. Roller collar 436 is mounted by a bearing on roller shaft 435 which is secured to one end of each roller support member 434 and freely rotatable.

Figure 10:
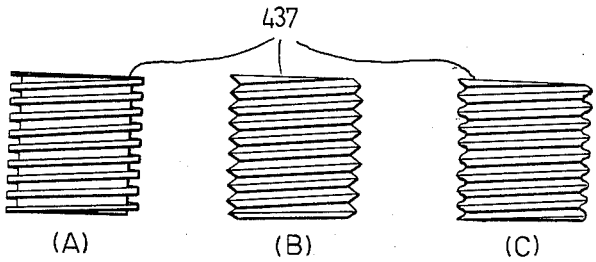
FIG. 10 is a sketch showing three types of threaded spiral on the grinding rollers.

The grinding device 4B furthermore comprises, as shown in FIG. 10, spiral grinding rollers 437 surrounding each roller collar 436 and secured thereto by means of bolts and nuts, a plurality of sweepers 438 fitted under a circular plate at the lower end of the radial frames 431. A plurality of scraping plates 439 (three in this embodiment) are fixed to a circumferential portion of the circular plate of radial frames 431 and inclined downward. Between rollers 437 and grinding ring 440 a clearance is established so that during rotation of main shaft 422, the roller come into contact with the inner wall of grinding ring 440 through action of centrifugal force.

Between grinding ring 440 and upper inner wall of lower housing 44 is placed anti-shock, sound-deadening material such as elastic pad 441 comprising rubber packings. Grinding ring 440 is secured to the upper wall of the lower housing 44 by means of rubber linings 462 and bolts 461 at appropriate intervals. A stationary collar 442 supports rotary collar 428 on a bearing surrounding the lower part of rotary collar 428. Stationary collar 442 extends from the bottom of air housing 43 through air housing 43. A dust-proof rubber packing 443 is plugged tightly between main shaft 422 and ring 430 to prevent dust particles from entering the bearing, and dust-proof cover 444 is slipped loosely over the middle section of main shaft 422 covering the upper part of ring 430.

The classifier device 4C is provided at the upper part of middle housing 45 and comprises a rotary collar 445 secured to main shaft 422 and having a plurality of holes for mounting vanes of it and a L or T shaped rotary vane 446, one end of which slips over a circumferential portion of rotary collar 445 and has two raised ear shaped portions with holes conforming to the vane-mounting holes in collar 445 and corresponding to another in upper and lower positions. Large head pins 447 pass through holes of rotary vane 446 and of rotary collar 445, and each has a cotter pin inserted through the other end so as to optionally assemble vane 446 or disassemble it from the rotary collar.

The product suction device 4D is provided inside of upper housing 46 and comprises an exhaust fan 449 having a plurality of vanes 448 secured at the upper end portion of main shaft 422.

As indicated previously, the mill comprises a mounting seat 42, air housing 43, lower housing 44, middle housing 45, upper housing 46 and motor seat frame 47. Gear box 48 is provided under air housing 43 inside the upper part of mounting seat 42, and contains speed reducer device 4A tightly sealed for filling lubricant oil. Air housing 43 is bolted on the upper part of mounting seat 42 by bolts and nuts. In the side wall of air housing 43 is provided exhaust port 450 to which is connected air return pipe 6 connected to cyclone dust collector 7. Exhaust chamber 451 is formed within air housing 43. Check window 452 is hinged to the front wall of air return pipe 6 and is free to open and close. Air baffle 61 is fitted adjacent to exhaust port 450 in air return pipe 6.

Lower housing 44 is provided at the upper part of air housing 43. Its interior space constitutes a grinding chamber wherein grinding roller 4B is located at the upper part thereof. Also, between grinding ring 440 and lower housing 44 is established a gap which constitutes a cooling chamber 453 for cooling grinding ring 440 by supplying cooling water through lower housing 44 via water inlet 454. A cooling water outlet 455 is fitted in the upper wall of lower housing 44.

Middle housing 45 is connected by means of bolts and nuts to the top of lower housing 44 and is provided with a raw material inlet 456 adjacent to which is provided feeder 3 connected with elevator 2. An inspection door 457 for the separation chamber, is located centrally in the wall of middle housing 45 and is free to open and close. Door 457 also serves as a manhole used in inspection, clearing and repair of the classifier device 4C in the separation chamber 458 and of roller device 4B in the grinding chamber 453, and disassembly of the rotary vane 446.

Upper housing 46 is provided on top of middle housing 45, centrally of its base there is provided an opening 549. Uptake pipe 5 is connected to the side wall and is formed as a sprial extension and connected to cyclone dust collector 7. The interior space of upper housing 46 constitutes exhaust chamber 460 and exhaust fan 449 is located therein.

Motor seat frame 47 is provided at the top of upper housing 46, on which is fixed electric motor $M_2$.

Returning to FIG. 1, cyclone dust collector 7 comprises cyclone body 74 supported by support frame 71 and provided at its upper cylindrical portion with an internal cyclinder 72, a part of which extends out of the upper end of cyclone body 74, and at the lower end of the lower conical portion with a gate valve 73. One end of uptake pipe 5 from pulverizer 4 is connected to the upper cylindrical portion of cylcone body 74. The upper part of air return pipe 6 connected to air housing 43 of pulverizer 4, is connected to air return port 75 in internal cylinder 72 and extends tangentially therefrom.

A duct 76 connects dust or product outlet 77 located centrally of the top wall of cylinder 72 with a bag-type filter. The upper ends of tubular bags 84 of filter 8 are suspended on suspension lugs secured to the upper circumferential rim of support frame 71 (in this embodiment, the above two adjacent sides of a four-corner support frame structure), and the lower ends are inserted into a plurality of dust collecting parts 83 provided at the top of dust chamber 82. The front view of chamber 82 presents a configuration of connecting bases of two triangles at right angles, and the top view of the chamber 82 presents a container of a thin, flat shape which is provided in L-configuration at the lower external circumferential portion of support frame 71 and the bottom of which is formed in an inclined shape. A dust outlet 85 is provided at the lowest end of the inclined part of the dust chamber 82.

The operation of the above described embodiment will now be described.

At first, all the electric motors are started to drive the various parts, and the raw material for pulverization, supplied to the raw material bin 1, is conveyed upward, in the direction shown by the arrows (unmarked) by elevator 2, driven by electric motor $M_1$ by means of transmission of sprockets 22,23,24. The raw material passes through feed port 36, over deflector plate 39 and into supply chamber 31. The raw material is fed therefrom to grinding chamber 453 of pulverizer 4 through raw material inlet 456 in middle housing 43 by feeding rotor 35 driven by motor $M_1$ through sprockets 32,33,34.

In chamber 453, the raw material is crushed and ground into powder by friction between grinding ring 440 and centrifugal grinding rollers 4B, driven by motor $M_2$, through the gear coupling 423, main shaft 422 and speed reducer device 4A. The pulverized material is carried upward by air stream generated by rotation of exhaust fan 449, classified by classifier device 4C with only pulverized material of required particle sizes being sucked into exhaust chamber 460 through the clearance at the central part of rotary vane 446, and the further conveyance into the uptake pipe 5 to the cyclone dust collecting device 7.

At the same time a part of the ground material with coarser and heavier particles lose their centrifugal force and drop gradually, and are stricken down by rotary vane 446 and returned to grinding chamber 453 to be repulverized. The material conveyed to cyclone collector 7 from uptake pipe 5 rotates along the circumference of the internal cylinder and is separated at the same time. In the cylinder only fine dust or powder drops downward and is discharged from gate valve 73 as the finished product.

In the meanwhile, air leaking into the sealed closed circuit system from the outside and water vapour and dust generated by the raw material are carried into the internal cylinder 72 along with the air stream. Only air is recovered from air return port 75 via air return pipe 6 into exhaust chamber 451 of air housing 43. Water vapour, hot exhaust and dust are passed from dust or product outlet 77 via duct 76 to bag-type filter 84. Water vapour and hot exhaust dissipate heat into the atmosphere at this point. At the same time residual superfine particles deposited in dust chamber 82 from bag-type filter 84 are collected at dust collecting ports 83.

Since a supply adjustment device 37 is provided at feed port 36 of feeder 3, the grinder status in the pulverizer 4 can be observed through exhaust check-window 452. It is also possible to use adjusting handle 312 and rack 313 to properly adjust the degree of inclination of deflector plate 39 so as to properly adjust the supply of raw material fed to feeding rotor 35 and at the same time to check raw material passing feeding rotor 35 and the quantity of raw material remaining in pulverizer 4 by observation through inspection window 317 so as to properly and accurately adjust the raw material supply fed to the feeding rotor 35 and keep the operation of the pulverizer at a maximum efficiency.

The external circumference of feeding rotor 35 is closely fitted the the housing. Thus, feed port 36 and supply chamber 31 are fully separated into two compartments. This can prevent air from entering into the pulverizer and from interfering with the centrifugal action of the air stream or dust generated in the pulverizer in the course of raw material supply. In the meanwhile, the overcharge will fall into raw material return pipe 314 from the clearance of the leading end of feed rotor 35 and of deflector plate 39 and will be recovered into bin 1. In this manner, malfunctions such as plugging of raw material in the machine will not occur and production can be smoothly maintained.

Pulverizer 4 has a main shaft whose upper and lower end portions are vertically supported in the center of mill cylinder 41. From top to bottom, the shaft is provided with a product suction device 4D, a classifier device 4C, a grinding roller device 4B with sweeper 438 and scraping plates 439, and a speed reducer device 4A, all of which are driven by an electric motor mounted on top of the mill cylinder.

This mill differs from the conventional Raymond Ring Roller Mill which requires a horizontal driving shaft extending outside of the mill, with transmission parts and base frame for mounting these parts. Thus, the inventive mill is simpler and since the configuration is smaller substantial reduction in mounting area is produced.

The grinding rollers are made hinged with respect to radial frames 431 and roller support arms 434 and are slipped over rotary collar 428, and therefore can rotate freely in the horizontal directions. Compared with the above discussed Raymond Mill, in which the rollers are supported at the upper end of a long shaft with the lower end portion and suspended by means of a radial frame to rotate freely upward and downward as a pendulum, the power loss of grinding rollers in accordance with the invention is smaller. Furthermore, owing to the consistency of the whole contact surfaces between the rollers and the grinding ring, the wear and malfunctions of parts and elements are very few, and thus its construction is sufficiently rigid to ensure longer life.

Between grinding ring 440 and lower housing 44 there is provided a cooling chamber 453'. The two ring bodies are fitted with elastic pads of rubber packings and rubber linings. Hence, it is possible to circulate cooling water to cool the parts and during pulverization, noise and vibrations, such as produced by the centrifugal force of the rollers, are absorbed by these pads so that noise and vibrations are reduced to a minimum. Moreover, overheating is reduced. Thus, it is possible to maintain reliable mechanical properties and effectively pulverize the materials which cannot survive high temperatures, and produce high quality products.

If the circulation of cooling water supplied to the cooling chamber is stopped, the air in the cooling chamber will counter flow due to the impact and shock caused by the rotation of grinding ring and rollers, and the cooling chamber will suck fresh air from the atmosphere through the water inlet 455, while the air absorbing heat in the cooling chamber will continually be discharged from the cooling water outlet in the same manner as an exhaust pipe of an automobile, for example, does to effect a forced automatic circulation of air. Thus the machine is constantly cooled and kept at a low temperature resulting in higher performance and efficiency.

Since the construction of the roller is of a spiral type, its grinding pressure is larger than that of the conventional flat roller and even a coarser raw material can be readily pulverized. In addition, all the particles pulverized subsequently or a part thereof fall into the spiral grooves, and, through the self-rotation of the rollers, are forced upward along the spiral grooves, causing the coarse particles to fall again onto the bottom of the grinding chamber for further pulverization without lingering on the grinding surface so as to constantly free the surface and obtain fine particles.

The selected types of spiral on the rollers are used correspondingly to effectively pulverize various raw materials such as solid, viscous and fibrous substances. Generally, solid materials such as mineral matters require a square shaped spiral roller; viscous materials require a triangle shaped spiral roller with round corners; and fibrous materials require a V-shaped spiral roller with sharp corners in order to obtain best results.

The classifier device comprising the rotary vane 446 is easy to assemble and disassemble, and is secured to the same main shaft 422 as the grinding roller device. The construction is simple. Proper selection of the number of vane plates will result in a product of required particle size. The conventional ring roller mill requires the attachment of a classifier with an external exhaust machine, and therefore, is complicated and inefficient and unreliable.

The dust collector device or the exhaust machine comprising an exhaust fan having a plurality of vanes 448 secured to the main shaft 422 in exhaust chamber 460 above the pulverizer has many advantages. Compared with the conventional construction of using a motor and an exhaust machine outside the main body, the mounting area of the present invention is substantially reduced. It is unnecessary to have an additional motor for driving the exhaust machine.

In the conventional ring roller machine or mill, the grind is blown upward to the upper part of the mill cylinder by air stream forced into the grinding chamber by means of an external fan from a air housing through a fixed type leading vane located in the air housing. However, as the direction of the air stream is opposite to that of the centrifugal air flow generated by the mill cylinder, and because a manifold piping system channelled to the bag type filter is installed on the path of an uptake pipe connecting the exhaust fan and the mill cylinder and a part of the air is introduced directly to the bag type filter, a high volumne exhaust fan is required in such conventional ring roller mills.

Also, the mobility of air flow in the conventional mill cylinder is low, and therefore, the raw material is easily plugged between the grinding chamber and the fixed type leading vane, thus hindering operation of the mill. It will be usually necessary to shut down the mill during operation to clear the blockage. As a result, operation is inefficient and maintenance is expensive.

In the present invention, a dust collector device, such as an exhaust fan, is provided in the upper part of the mill cylinder and the air is sucked directly upward into upper housing 46 from air housing 43, via an uptake port in the central part of lower housing 44, grinding chamber, separation chamber and section opening, and blown into uptake pipe 5. Thus, the air stream is maintained without interference and can easily suck in the particles which are revolving and rising together with the upward air stream. Also, there is no decentralization of air flow caused by the manifold. Therefore, its energy loss is small. Sophisticated piping and fittings are not needed. No plugging of the raw material will occur.

The dust cyclone collector and the bag type filter are fitted to the same support frame around which are provided a dust or product chamber with special construction. The entire arrangement is of intensive structure and results in savings of mounting space.

When the temperature of air recovered in the mill cylinder from the dust cyclone collector via the air return pipe increases, if air baffle 61 is pulled tightly and the window of air supply hole 62 is opened, cold air will be automatically supplied through cold air supply hole 62 directly from the atmosphere and discharged from the bag type filter into the atmosphere. Thus, the temperature of the system will drop immediately to the normal level.

When overcharged, the raw material may be plugged in the system, and the electric motor becomes overloaded. The supply adjustment device 37 can they be fully opened so that all the raw material is conveyed from the elevator back through the return pipe 314 to the bin 1. After the work load of the motor returns to normal, the supply adjustment device can be readjusted to effect a proper volumne of supply, and the grinding operation of the machine can become normal.

If a conventional mill were used, it would be necessary to shut down the mill every time there is an overcharge of material, and the machine must be cleaned. The present invention need not be shut down, and normal operation can be readily resumed after a short period by mere adjustment of the adjustment device.

The speed reducer, dust sweep, separation and dust collector devices in the pulverizer are driven by one motor and one main shaft. No marginal conditions exist therein. The air circulation is optimal. Hence, power requirement, installation costs, maintenance expenses are substantially less than those of the prior art. Usually, two thirds of the power consumed with conventional equipment is required in this invention, with the resultant production of substantially greater output.

The total area required for mounting or placing the equipment is only one third that required for conventional equipment of the same capacity.

The present invention's efficiency is high. Even a super-fine particle size is easily obtainable. Regardless of the type of material is used, such as solid, viscous, or fibrous, selected types of spirals can be used to effect ideal pulverization. Thus, the utility of the invention is substantial. It can accomplish more than that of conventional mills.

The dust or product collector device is provided on the top of the classifier device, and only the classified grind will be sucked and conveyed to the cyclone collector. Thus, a powder like product of uniform particle size can be obtained.

In order to yield products of the highest quality in accordance with the nature and type of specific raw materials, the gear ratio of speed reducer device may be changed if necessary to adjust the rotational speed of the grinding rollers. The interchange of gears may be done simply and easily.

After use, the raw material or grind attached to the inner wall of the mill cylinder can be scrapped off and the power supply is put on to run the machine for only two or three minutes to clean it automatically without manual labor.

The overall rate of malfunctions is low; the assembly of parts and elements is a simple operation and maintenance and repair of the whole equipment are easy to effect.

During operation there is no dust or particles emitted to the exterior of the mill. Thus, the surroundings is clean.

The foregoing embodiment was set forth for illustrative purposes only; numerous variations and modifications thereof would be evident to one skilled in the art. All such variations and modifications are to be considered within the spirit and scope of the invention.

What is claimed is:

1. Pulverizing apparatus comprising a vertical container having from bottom to top therein mounting seat means, air housing means having an air inlet means provided therein, speed reducing means disposed beneath said air housing means, lower housing means, grinding means disposed in said lower housing means, middle housing means having inlet means provided in the wall thereof, classifier means disposed in said middle housing above said grinding means, upper housing means having spiral outlet means extending from the wall thereof, exhaust means disposed in said upper housing means, motor seat frame means, shaft means located substantially at the center of said container and extending vertically and connected to said speed reducing means, said grinding means, said classifier means and said exhaust means, one end of said shaft being supported by a collar means positioned centrally of said air housing means, and the other end of said shaft extending to the top of said vertical container, drive means comprising motor means mounted on said seat frame means and gear means for driving said shaft means, feed port means positioned adjacent said inlet means to receive raw material from a source, supply adjustment means for adjusting the opening of said feed port means, return pipe means connected to said adjustment means for returning unfed raw material to said source, means disposed above said classifier means for removing said material ground by said grinding means in said middle housing means, means disposed toward the lower portion of said vertical container for sweeping smaller sized objects of said material and carrying same to said grinding means, air forcing means in said housing means for circulating said ground material upward and to said collecting means.

2. Apparatus of claim 1, wherein said grinding means is of hinge type construction, and includes spiral threaded rollers.

3. Apparatus of claim 1, wherein said classifier means comprises one or more removable rotary vanes.

* * * * *